US009097404B2

(12) United States Patent
Dhenaut et al.

(10) Patent No.: US 9,097,404 B2
(45) Date of Patent: Aug. 4, 2015

(54) REINFORCEMENT DEVICE, LIGHTING DEVICE SOCKET, LIGHTING DEVICE ASSEMBLY AND VEHICLE

(75) Inventors: Matthieu Dhenaut, Bonvillaret (FR); Jelle Pelsma, Chartres (FR); Hani Debes, Aachen (DE); Vanessa Doree, Palaiseau (FR); Antonius N. Theelen, Eindhoven (NL); Victor Geelen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 555 days.

(21) Appl. No.: 12/601,854

(22) PCT Filed: May 30, 2008

(86) PCT No.: PCT/IB2008/052121

§ 371 (c)(1), (2), (4) Date: Nov. 25, 2009

(87) PCT Pub. No.: WO2008/146258

PCT Pub. Date: Dec. 4, 2008

(65) Prior Publication Data

US 2011/0228563 A1 Sep. 22, 2011

(30) Foreign Application Priority Data

Jun. 1, 2007 (EP) ..... 07290686

(51) Int. Cl.

| | |
|---|---|
| ***H01R 33/00*** | (2006.01) |
| ***F21V 19/00*** | (2006.01) |
| ***F21S 8/10*** | (2006.01) |

(52) U.S. Cl.
CPC ..... *F21V 19/00* (2013.01); *F21S 48/1109* (2013.01); *F21S 48/212* (2013.01)

(58) Field of Classification Search
CPC ..... F21S 48/1109; F21S 48/212; F21V 19/00
USPC ..... 362/656, 382
See application file for complete search history.

(56) References Cited

U.S. PATENT DOCUMENTS

| | | | | |
|---|---|---|---|---|
| 4,513,356 | A | 4/1985 | Mikola | |
| 4,682,274 | A * | 7/1987 | Freudenreich et al. | 362/519 |
| 4,822,302 | A * | 4/1989 | Dorleans | 439/544 |

(Continued)

FOREIGN PATENT DOCUMENTS

| | | | |
|---|---|---|---|
| DE | 10132853 | A1 | 2/2002 |
| EP | 1102001 | A2 | 5/2001 |

(Continued)

*Primary Examiner* — Anh Mai
*Assistant Examiner* — Jessica M Apenteng

(57) ABSTRACT

The invention relates to a reinforcement device (5) for a catch element (31) of a lighting device socket (3), said catch element (31) comprising a plurality of catch flanges (32) for engaging with the base (22) of a lighting device (2) when said lighting device (2) is pushed in said lighting device socket (3), said catch flanges (32) extending perpendicularly to the lighting device socket plane. The reinforcement device (5) comprises a ring (6) and bracing means (7) integral with said ring (6) and capable of bracing at least one catch flange (32) of said catch element (31) against the base (22) of a lighting device when a lighting device (22) is positioned in said lighting device socket (3). The invention also relates to a lighting device socket (3) comprising such a reinforcement device (5), a lighting device assembly and a vehicle.

11 Claims, 4 Drawing Sheets

(56) References Cited

U.S. PATENT DOCUMENTS

| | | | | |
|---|---|---|---|---|
| 4,898,291 | A | 2/1990 | Sailors | |
| 4,964,852 | A | 10/1990 | Dunning et al. | |
| 5,238,152 | A | 8/1993 | Maas et al. | |
| 5,400,685 | A | 3/1995 | Cappella | |
| 5,800,183 | A * | 9/1998 | Paul et al. | 439/56 |
| 6,217,340 | B1 | 4/2001 | Gordon | |
| 6,253,936 | B1 | 7/2001 | Kong | |
| 6,835,436 | B1 | 12/2004 | Reif et al. | |
| 2001/0034889 | A1 | 11/2001 | LoMedico | |
| 2005/0217155 | A1 | 10/2005 | Santa Cruz | |

FOREIGN PATENT DOCUMENTS

| | | | |
|---|---|---|---|
| EP | 1610056 | A1 | 12/2005 |
| WO | 2007105144 | A1 | 9/2007 |

* cited by examiner

REINFORCEMENT DEVICE, LIGHTING DEVICE SOCKET, LIGHTING DEVICE ASSEMBLY AND VEHICLE

TECHNICAL FIELD

The invention relates to a reinforcement device for a lighting device socket and to a lighting device assembly which comprises such a reinforcement device.

BACKGROUND OF THE INVENTION

High performance lamps, such as HiPer Vision lamps by Philips, are interesting in the automotive industry for various reasons, among which because they have a useful life that is of the same order as that of a vehicle equipped with such lamps. In other words, it is seldom necessary to replace these lamps.

To prevent deterioration of high performance lamps, they are usually assembled to the lamp socket through a clickable plastic element.

A lighting device assembly 1 of the prior art, as depicted on FIG. 5, comprises a lamp 2 and a lamp socket 3. The lamp socket contains the necessary electric connections in order to supply power to the lamp 2. The lamp 2 has a lamp bulb 21 and a lamp base 22 which cooperates with the lamp socket 3 for power supply and positioning, for instance with current conducting elements (not shown) lodged in corresponding housings provided on the lamp socket 3. In order to prevent the lamp 2 from being dislodged from the lamp socket 3, the lamp socket 3 is equipped with catch element 31, which comprises a plurality of catch flanges 32. The catch flanges 32 extend perpendicularly to the lamp socket plane. They may be regularly arranged along a circle. The catch flanges comprise a flange head 33 and a leg 34. The flange head 33 has a bevelled guiding surface 35 which ends at a shoulder 36. When a lamp 2 is pushed in the lamp socket, the catch flanges 32 are pushed outwardly along their bevelled guiding surface 33 until the shoulder 36 engages with the base 22 of the lamp 2. Thus, the lamp 2 is assembled to the lamp socket 3 with a clickable catch element 31. The lamp socket may be made of a heat resistant plastic material, in order to prevent damage to the lamp 2.

However, in various appliances such as daytime running appliances where the catch element 31, and more particularly the catch flanges 32, undergoes prolonged mechanical stress under long term exposure to heat, the catch element 31 may suffer permanent deformation. Such observations have been made after a long time span, for instance from a few weeks to a few months. This may result in the lamp 2 becoming loose in the lamp socket 3, which is undesirable for various reasons such as security or obligation to remove the lamp assembly and replace it although the lamp has not reached its useful life yet.

SUMMARY OF THE INVENTION

It is an object of embodiments of the invention to avoid the undesirable effects of permanent plastic deformation of a lighting device socket, so as, inter alia, to prevent loosening of a lighting device and to prolong the useful life of a lighting device assembly.

To this end, an embodiment of the invention proposes a reinforcement device for a catch element of a lighting device socket, said catch element comprising a plurality of catch flanges for engaging with the base of a lighting device when a lighting device is pushed in said lighting device socket, said catch flanges extending perpendicularly to the lighting device socket plane, wherein said reinforcement device comprises a ring and bracing means integral with said ring and capable of bracing at least one catch flange of said catch element against the base of a lighting device when a lighting device is positioned in said lighting device socket.

In the present application, the expression "lighting device" relates to any device capable of emitting light, such as a lamp, a LED, an OLED, and so on.

In an embodiment of the invention, said ring comprises positioning means for positioning rotationally said reinforcement device with respect to said catch element of said lighting device socket. In another embodiment, said bracing means comprise at least one leaf spring extending from the ring. In yet another embodiment, at least one leaf spring comprises means for positioning axially said reinforcement device with respect to said catch element of said lighting device socket.

Another embodiment of the invention proposes a lighting device socket comprising a housing for receiving current conductive elements of a lighting device, a catch element comprising a plurality of catch flanges for engaging with the base of a lighting device when said lighting device is pushed in said lighting device socket, said catch flanges extending perpendicularly to the lighting device socket plane, and further comprising a reinforcement device comprising a ring and bracing means integral with said ring and capable of bracing at least one catch flange of said catch element against the base of a lighting device when a lighting device is positioned in said lighting device socket.

In an embodiment, said bracing means comprise at least one leaf spring extending from the ring. In another embodiment, the base of said catch flanges is provided with a housing adapted for receiving said leaf spring, such that said bracing means are inner bracing means. In a further embodiment, said leaf spring presses against said catch flange, such that said bracing means are outer bracing means.

A further embodiment of the invention relates to a lighting device assembly comprising a lighting device socket as disclosed herein and a lighting device engaged in said lighting device socket.

Embodiments of the invention also relate to a vehicle equipped with at least one lighting device socket or at least one lighting device assembly as disclosed herein.

These and other aspects, features and advantages of the invention will become apparent to those skilled in the art upon reading the disclosure provided here in connection with the attached drawings. The detailed description, while indicating preferred embodiments of the invention, is only given by way of illustration.

BRIEF DESCRIPTION OF THE DRAWINGS

The invention will now be described in more details by way of example with reference to the accompanying drawings, in which.

DETAILED DESCRIPTION OF THE INVENTION

It must be noted that as used in this specification and the appended claims, the singular forms "a", "an", and "the"

include plural referents unless the context clearly dictates otherwise. Unless defined otherwise, all technical and scientific terms herein have the same meaning as commonly understood by one of ordinary skill in the art to which this invention belongs.

Although the described examples relate to a lamp, such as an incandescent lamp or a discharge lamp, it may be applied to any kind of lighting device, such a LED or an OLED.

Figure 1:
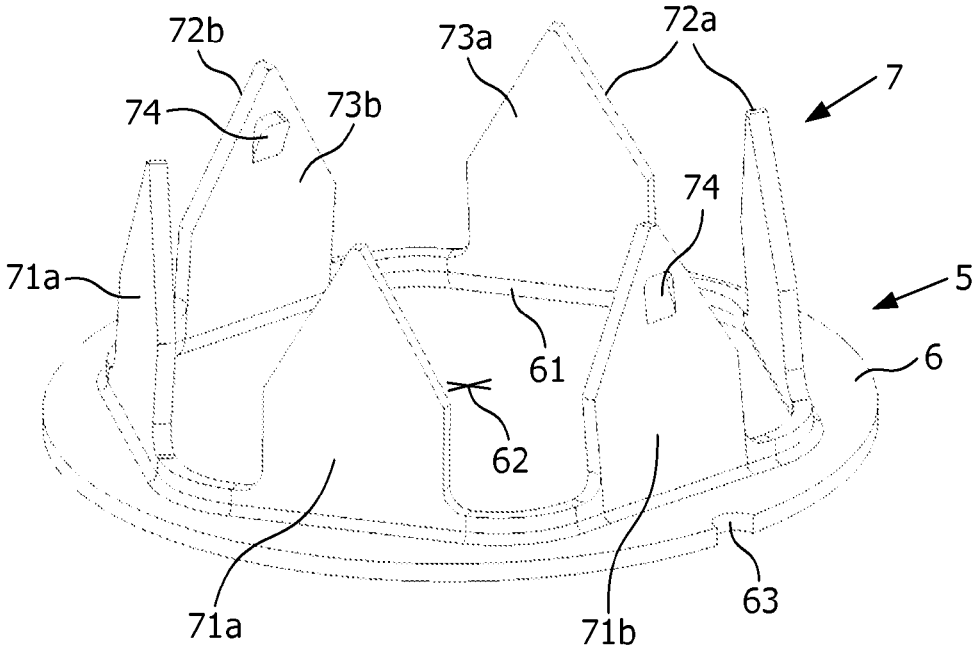
FIGS. 1 and 2 show a perspective view of a reinforcement device according to first and second embodiments of the invention.
Figure 2:
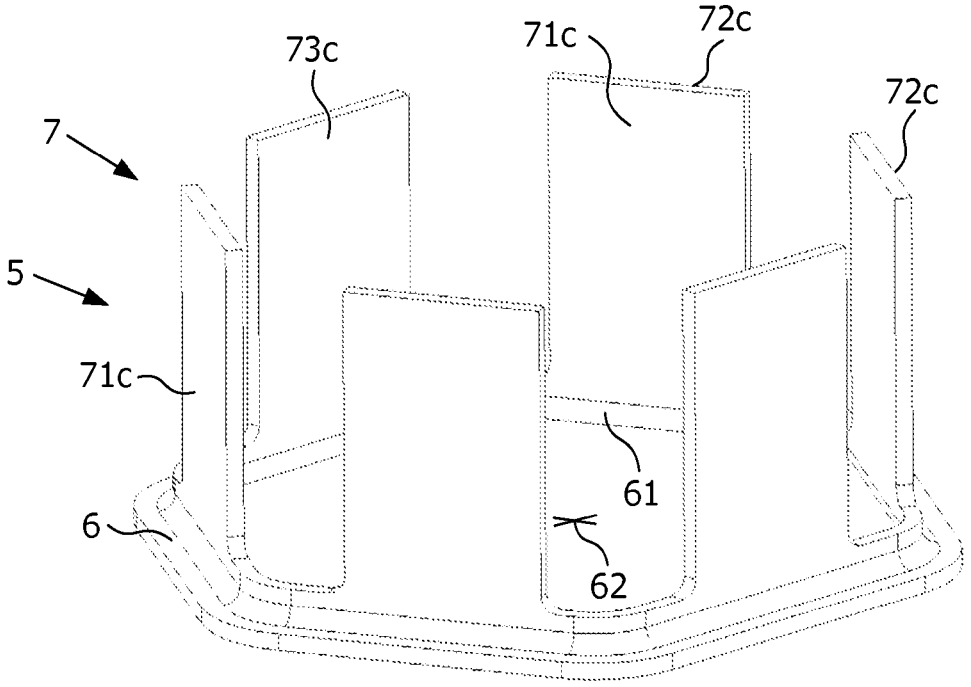
Figure 5:
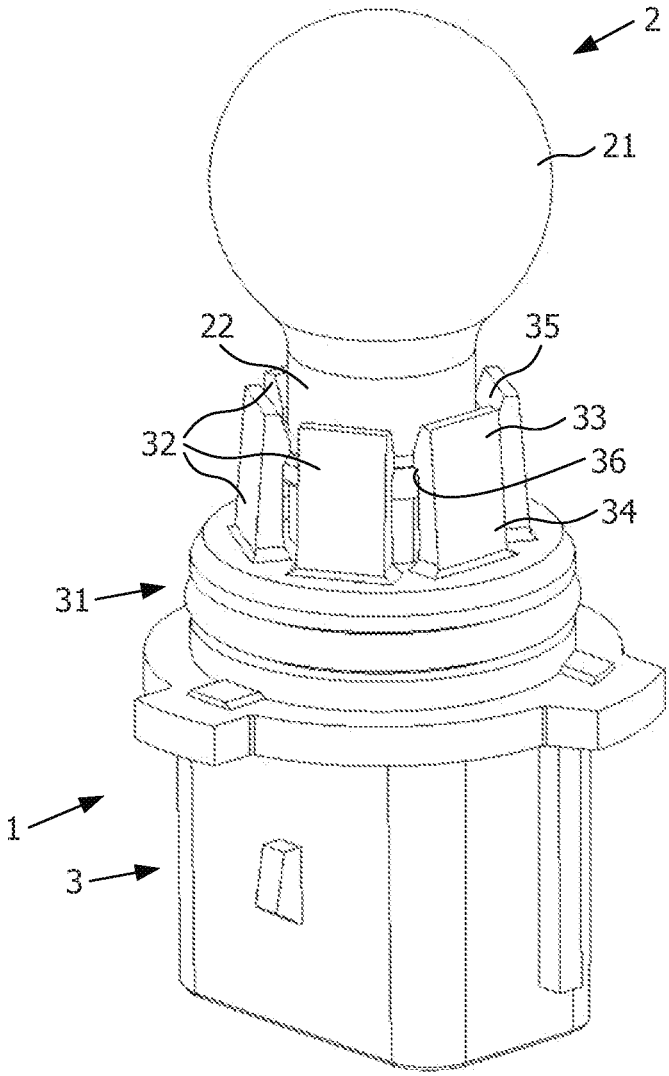
FIG. 5 PRIOR ART
FIG. 5 shows a perspective view of a prior art lamp assembly.

FIGS. 1 and 2 depict first and second embodiments of a reinforcement device 5 useful for reinforcing a catch element of a lamp socket. For the purpose of description, reference is also made to FIG. 5. The reinforcement devices 5 comprise a ring 6 and bracing means 7 integral with the ring 6. Preferably, the bracing means 7 comprise at least one leaf spring 71*a*, 71*b*, 71*c* (collectively denoted 71) extending from the ring 6. The leaf springs 71 have a proximal zone, close to the ring 6 and a distal extremity 72*a*, 72*b*, 72*c* (collectively denoted 72). The leaf springs 71 are slightly inclined towards the centre 62 of the ring 6 so that the distal extremity 72 of the leaf springs 71 are arranged on a virtual ring which has smaller dimensions than the ring 6. Thus, when the reinforcement device 5 is assembled to the lamp socket 3, the inner surface 73*a*, 73*b*, 73*c* (collectively denoted 73) of the leaf springs 71 presses against the catch flanges 32 of the lamp socket 3 and braces said catch flanges 32 against the base 22 of lamp 2 when a lamp is positioned in said lamp socket 3. In the event that the catch flanges 32 suffer from a mechanical deformation, the bracing means 7 prevent the mechanical deformation from appearing.

In a preferred embodiment, the bracing means 7 comprise as many leaf springs 71 as there are catch flanges 32 on the catch element 31 of the lamp socket 3. In such a configuration, one leaf spring 71 cooperates with one catch flange 32. This is illustrated on FIGS. 1 to 4, where the catch element comprises six catch flanges 32 and where the reinforcement device comprises six leaf springs 71. However, the number of six catch flanges and six leaf springs is not compulsory. Preferably, the catch element 31 and the bracing means 7 comprise at least two diametrically opposed catch flanges 32 and leaf springs 71. An advantageous feature is that the catch flanges 32 and the leaf springs 71 be arranged equidistantly around the catch element 31 and the ring 6. In another embodiment, the bracing means comprise only two diametrically opposing leaf springs 71.

In an advantageous embodiment, the ring 6 is a positioning ring. The positioning ring 6 comprises means for imparting a desired position to the reinforcement device 5 with respect of the catch element 31 of a lamp socket 3. For instance, the inner profile 61 of the positioning ring 6 is provided so that it matches the outer profile of the catch element 32. In the depicted embodiments, the inner profile 61 of the positioning ring 6 is provided so that it matches the outer profile of the catch element 32 are regular hexagon-shaped. Thus, the reinforcement device 5 can be easily fitted with respect to the catch element 31. In another embodiment, the ring 6 is provided with a positioning slot 63 which may cooperate with a positioning nib of the catch element 31. Thus the reinforcement device 5 may be positioned rotationally with respect to the catch element 31.

As shown on FIG. 1, the bracing means 7 may comprise different leaf springs 71*a*, 71*b*. For instance, the distal extremity 72*b* of a leaf spring 71*b* may be provided with a notch 74 extending inwardly from the leaf spring 71*b* towards the centre 62 of the ring 6. When the reinforcement device 5 is assembled with the catch element 31, this notch 74 may prevent the reinforcement device 5 from sliding axially along the catch element 31. For instance, sliding may occur with time under the effect of vibrations from an automotive vehicle. Thus, the reinforcement device 5 is positioned axially with respect of the catch element 31.

In a preferred embodiment, the reinforcement device 5 is made of metal or of metal alloy. Various metal forming processes may be implemented for manufacturing the reinforcement device 5. For instance, metal stamping is a process employed in manufacturing metal parts with a specific design. A metal or metal alloy sheet is used as the stock. This stock is either stamped on a press using dies and punches or drawn into shapes on hydraulic deep drawing machines. Metal stamping processes use dies (female component of the stamp) and punches (male component of the stamp) to cut the metal into the required shape. Press machine tools are used in the stamping process. The die, made of hardened steel, has a contour that matches the shape of the finished part and is mounted on the table of the press. The punch, usually made of hardened tool steel or carbide, also matches the contour of the part but is slightly smaller to allow clearance between the die and the punch. It is mounted in the head or the turret, which moves down and punches the metal. The thickness of the sheet metal does not change during this process. Other techniques may be used such as fine blanking, deep drawing or progressive die stamping.

Figure 3:
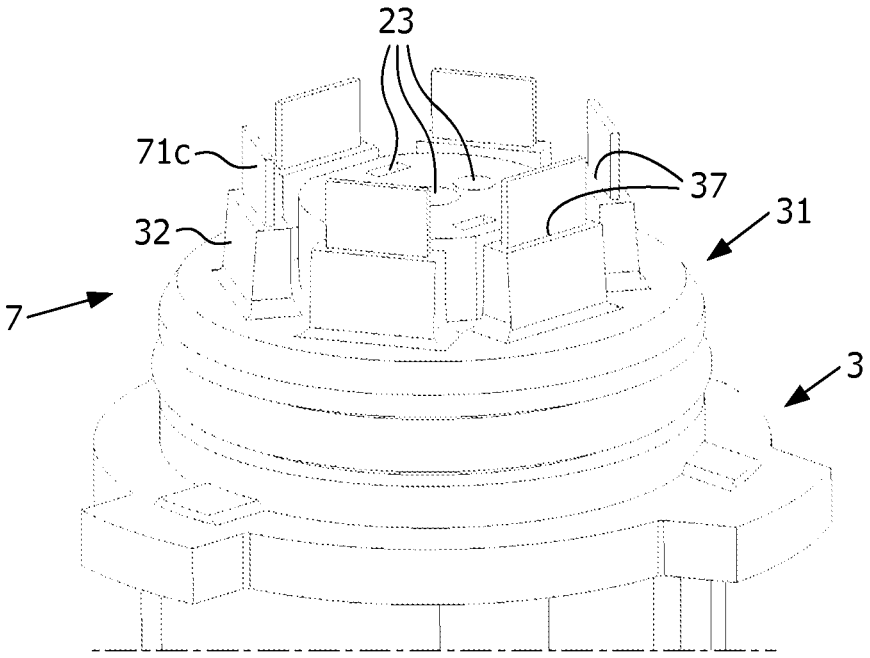
FIG. 3 shows a perspective partial view of a lamp socket comprising a reinforcement device as shown on FIG. 2.
Figure 4:
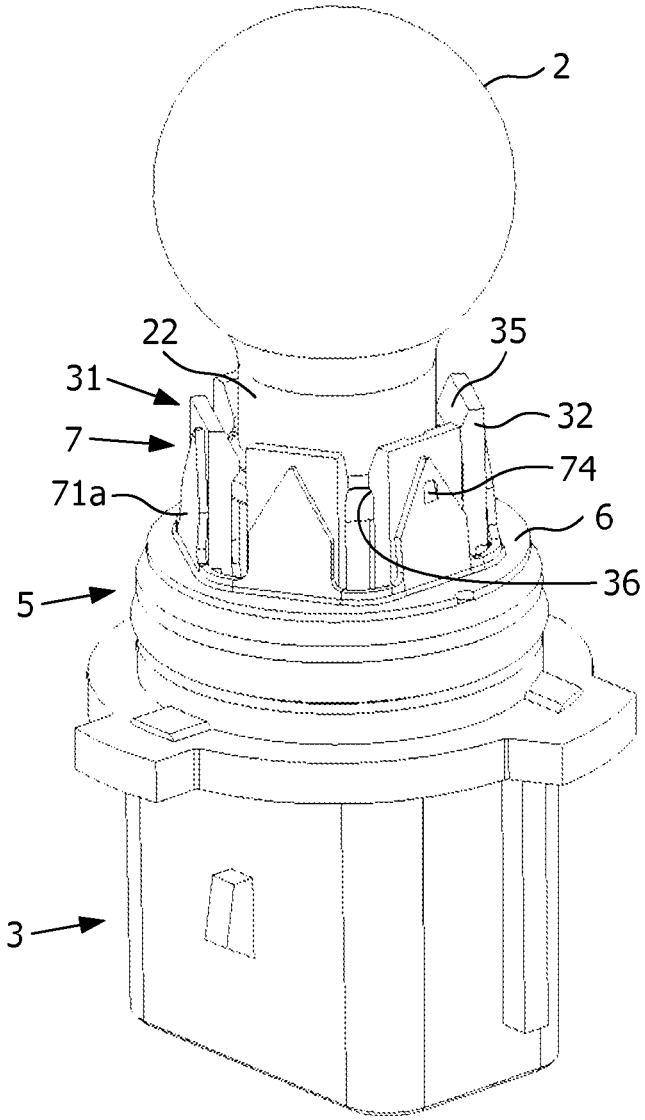
FIG. 4 shows a perspective view of a lamp assembly comprising an outer reinforcement device such as the reinforcement device shown on FIG. 1.

The reinforcement device 5 may act as an inner bracing means or as an outer bracing means. They may be compared to an inner skeleton or an outer skeleton. FIG. 3 depicts the case of inner bracing means. It should be noted that in use, this reinforcement device is not normally visible because it is housed in the catch element 31 of the lamp socket 3. Accordingly, the lamp assembly may have the same outside appearance as the lamp assembly depicted in FIG. 5. FIG. 4 depicts the case of outer bracing means.

On FIG. 3, the heads of the catch flanges 32 have been cut out in order to show the structure of the catch element 31 equipped with an inner reinforcement device 5, such as the reinforcement device depicted on FIG. 2. In this embodiment, the base of the catch flanges 32 is provided with a housing 37 adapted for receiving the leaf spring 71*c*. Advantageously, the housing 37 matches the shape of the leaf spring 71*c* so that the leaf spring 71 is not loose inside the housing 37. Moreover, this improves the bracing effect of the leaf spring 71 on the catch flanges 32.

Moreover, the lamp socket comprises housings 23 for receiving current conductive elements of a lamp 2. This is a conventional feature that does not necessitate further developments.

FIG. 4 illustrate another embodiment of the invention, wherein a catch element 31 is reinforced with an outer reinforcement device 5. The reinforcement device is similar to that of FIG. 1.

A vehicle may be equipped with a lighting device assembly as disclosed herein. The processes for incorporating such lighting device assemblies are commonly known. Vehicles may be cars, motorcycles, trucks, boats . . . .

The foregoing description of preferred embodiments of the invention is not intended to be exhaustive or to limit the invention to the disclosed embodiments. Various changes within the scope of the invention will become apparent to those skilled in the art and may be acquired from practice of the invention.

The invention claimed is:

1. A reinforcement device (5) for a catch element (31), said catch element (31) being an element of a lighting device socket (3), said lighting device socket for receiving a lighting device, the lighting device comprising a base; said catch element (31) comprising a plurality of catch flanges (32) for engaging with the base (22) of the lighting device (2) when the lighting device (2) is pushed in said lighting device socket (3), said catch flanges (32) extending perpendicularly to the lighting device socket plane; said reinforcement device (5) comprising:

a ring (6);

a bracing means (7) integral with said ring (6) and capable of bracing at least one catch flange (32) of said catch element (31) against the base (22) of the lighting device (2) when the lighting device (2) is positioned in said lighting device socket (3); wherein said at least one catch flange is in direct contact with the bracing means; and, wherein said lighting device socket is equipped with said catch element (31).

2. The reinforcement device (5) as claimed in claim 1, wherein said ring (6) comprises positioning means (61, 63) for positioning rotationally said reinforcement device (5) with respect to said catch element (31) of said lighting device socket (3).

3. The reinforcement device (5) as claimed in claim 1, wherein said bracing means (7) comprise at least one leaf spring (71*a*, 71*b*, 71*c*) extending from the ring (6).

4. The reinforcement device (5) as claimed in claim 3, wherein at least one leaf spring (71*b*) comprises means (74) for positioning axially said reinforcement device (5) with respect to said catch element (31) of said lighting device socket (3).

5. A lighting device socket (3) for use in combination with a separate reinforcement device (5), said lighting device socket (3) comprising:

a housing (23) for receiving current conductive elements of a lighting device (2), said lighting device comprising a base;

a catch element (31) comprising a plurality of catch flanges (32) for engaging with the base (22) of the lighting device (2) when the lighting device (2) is pushed in said lighting device socket (3), said catch flanges (32) extending perpendicularly to the lighting device socket plane; and, wherein said reinforcement device (5) comprising a ring (6) and bracing means (7) integral with said ring (6) and capable of bracing at least one catch flange (32) of said catch element (31) against the base (22) of a lighting device (2) when a lighting device (2) is positioned in said lighting device socket (3); wherein said at least one catch flange is in direct contact with the bracing means.

6. The lighting device socket (3) of claim 5, wherein said bracing means (7) comprise at least one leaf spring (71*a*, 71*b*, 71*c*) extending from the ring (6).

7. The lighting device socket (3) of claim 6, wherein the base of said catch flanges (32) is provided with a housing (37) adapted for receiving said leaf spring (71*c*), such that said bracing means (7) are inner bracing means.

8. The lighting device socket (3) of claim 6, wherein said leaf spring (71*a*, 71*b*) presses against said catch flange (32), such that said bracing means are outer bracing means.

9. A lighting device assembly comprising a lighting device socket (3) as claimed in claim 5 and a lighting device (2) engaged in said lighting device socket (3).

10. A vehicle equipped with at least one lighting device socket (3) as claimed in claim 5.

11. A reinforcement device (5) for a catch element (31), said catch element being an element of a lighting device socket (3), said lighting device socket for receiving a lighting device, the lighting device comprising a base; said catch element (31) comprising a plurality of catch flanges (32) for engaging with the base (22) of the lighting device (2) when the lighting device (2) is pushed in said lighting device socket (3), said catch flanges (32) extending perpendicularly to the lighting device socket plane; said reinforcement device (5) comprising:

a ring (6);

a bracing means (7) integral with said ring (6) and capable of bracing at least one catch flange (32) of said catch element (31) against the base (22) of the lighting device (2) when the lighting device (2) is positioned in said lighting device socket (3), wherein said at least one catch flange is then in direct contact with the bracing means;

wherein at least one of said plurality of catch flanges comprises a flange head (33) having a beveled guiding surface (35) which ends at a shoulder (36); and, wherein said lighting device socket is equipped with said catch element (31).

* * * * *